US009268268B2

(12) United States Patent
Shibasaki et al.

(10) Patent No.: US 9,268,268 B2
(45) Date of Patent: Feb. 23, 2016

(54) HEATING DEVICE CONTROLLING HEATING SWITCH TO PERFORM SWITCHING ACTION BASED ON SIGNAL

(71) Applicant: BROTHER KOGYO KABUSHIKI KAISHA, Nagoya-shi, Aichi-ken (JP)

(72) Inventors: Akihiro Shibasaki, Tokoname (JP); Katsumi Inukai, Iwakura (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/316,080

(22) Filed: Jun. 26, 2014

(65) Prior Publication Data

US 2015/0003854 A1 Jan. 1, 2015

(30) Foreign Application Priority Data

Jun. 28, 2013 (JP) ..... 2013-135991

(51) Int. Cl.

| | |
|---|---|
| ***G03G 15/20*** | (2006.01) |
| ***G03G 15/00*** | (2006.01) |
| ***H05B 1/02*** | (2006.01) |

(52) U.S. Cl.

CPC ..... *G03G 15/2039* (2013.01); *G03G 15/80* (2013.01); *H05B 1/0241* (2013.01)

(58) Field of Classification Search

CPC combination set(s) only.
See application file for complete search history.

(56) References Cited

U.S. PATENT DOCUMENTS

2009/0214246 A1 8/2009 Mochizuki

FOREIGN PATENT DOCUMENTS

| | | | |
|---|---|---|---|
| JP | 11-272103 | A | 10/1999 |
| JP | 2005-010689 | A | 1/2004 |
| JP | 2009-204638 | A | 9/2009 |
| JP | 2010-181567 | A | 8/2010 |
| JP | 2012-208450 | A | 10/2012 |

*Primary Examiner* — Clayton E Laballe
*Assistant Examiner* — Jas Sanghera
(74) *Attorney, Agent, or Firm* — Merchant & Gould PC

(57) ABSTRACT

In a heating device, a detector detects AC voltage of the AC power source. A control device detects a zero-cross timing of the AC voltage by using the detector and generate a signal having a high level period of time, a low level period of time, a rising transition changing from a low level to a high level, and a falling transition changing from the high level to the low level. The signal is such a form that at least one of the rising transition and the falling transition is in incoincidence with the zero-cross timing. The control device controls the heating switch to perform a switching action in which the heating switch is rendered on when the zero-cross timing is detected during the high level period of time and rendered off when the zero-cross timing is detected during the low level period of time.

27 Claims, 12 Drawing Sheets

HEATING DEVICE CONTROLLING HEATING SWITCH TO PERFORM SWITCHING ACTION BASED ON SIGNAL

CROSS REFERENCE TO RELATED APPLICATION

This application claims priority from Japanese Patent Application No. 2013-135991 filed Jun. 28, 2013. The entire content of the priority application is incorporated herein by reference.

TECHNICAL FIELD

The present invention relates to a technology for controlling the supply of an AC voltage to a heating body.

BACKGROUND

Conventionally, components of image-forming devices have been driven by AC power supplied from a commercial power supply. Japanese Patent Application Publication No. 2012-208450 describes a technology for controlling electricity conducted to a heater by switching a conduction signal at a timing based on the detection timing for zero-cross points in the outputted AC voltage. With this type of image-forming device, it is desirable to synchronize the timing at which the conduction signal is switched with the timing at which a zero-cross point is detected in order to reduce noise and power consumption.

SUMMARY

In order to synchronize the switch timing of the conduction signal with the detection timing of a zero-cross point, it is necessary to toggle the conduction signal at the timing that a zero-cross point is detected. To accomplish this, the conventional image-forming device generates an internal signal separate from the conduction signal and switches this internal signal together with the conduction signal. In this way, the image-forming device can determine, at the detection timing of a zero-cross point, that the conduction signal is being switched to ON if the internal signal is on and that the conduction signal is being switched to OFF if the internal signal is off.

According to this method, the internal signal must be switched at a relatively short period corresponding to the timing at which the zero-cross points are detected. However, if the timing at which the internal signal is switched overlaps the timing at which a zero-cross point is detected, the state of the internal signal may be indeterminate when the image-forming device is switching the conduction signal, leading to instability in the control of electricity conducted to the heater or other heating body.

In view of the foregoing, it is an object of the present invention to provide a technology for controlling the conduction of electricity to a heating body based on zero-cross points of an AC voltage.

In order to attain the above and other objects, the invention provides a heating device may include a heating body, a heating switch, a detector, and a control device. The heating body may be configured to be connected to an AC power source and generate heat by power supplied from the AC power source. The heating switch may be configured to be connected between the AC power source and the heating body and configured to switch supply of the power from the AC power source to the heating body. The detector may be configured to detect AC voltage of the AC power source. The control device may be configured to: detect a zero-cross timing of the AC voltage by using the detector; generate a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and control the heating switch to perform a switching action in which the heating switch is rendered on when the zero-cross timing is detected during the high level period of time and rendered off when the zero-cross timing is detected during the low level period of time.

According to another aspect, the present invention provides an image forming device. The image forming device may include an image forming unit, and a fixing device. The image forming unit may be configured to print an image on a sheet. The fixing device may be configured to fix the image on the sheet. The fixing device may include a heating body, a heating switch, a detector, and a control device. The heating body may be configured to be connected to an AC power source and generate heat by power supplied from the AC power source. The heating switch may be configured to be connected between the AC power source and the heating body and configured to switch supply of the power from the AC power source to the heating body. The detector may be configured to detect AC voltage of the AC power source. The control device may be configured to: detect a zero-cross timing of the AC voltage by using the detector; generate a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and control the heating switch to perform a switching action in which the heating switch is rendered on when the zero-cross timing is detected during the high level period of time and rendered off when the zero-cross timing is detected during the low level period of time.

According to still another aspect, the present invention provides a method for controlling a heating device. The heating device includes: a heating body configured to be connected to an AC power source and generate heat by power supplied from the AC power source; a heating switch configured to be connected between the AC power source and the heating body and configured to switch supply of the power from the AC power source to the heating body; and a detector configured to detect AC voltage of the AC power source. The method includes: detecting a zero-cross timing of the AC voltage by using the detector; generating a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and controlling the heating switch to perform a switching action in which the heating switch is rendered on when the zero-cross timing is detected during the high level period of time and rendered off when the zero-cross timing is detected during the low level period of time.

According to still another aspect, the present invention provides a non-transitory computer readable storage medium storing a set of program instructions installed on and executed by a computer for controlling a heating device including: a heating body configured to be connected to an AC power source and generate heat by power supplied from the AC power source; a heating switch configured to be connected between the AC power source and the heating body and configured to switch supply of the power from the AC power source to the heating body; and a detector configured to detect AC voltage of the AC power source. The program instructions includes: detecting a zero-cross timing of the AC voltage by using the detector; generating a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and controlling the heating switch to perform a switching action in which the heating switch is rendered on when the zero-cross timing is detected during the high level period of time and rendered off when the zero-cross timing is detected during the low level period of time.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

Figure 1:
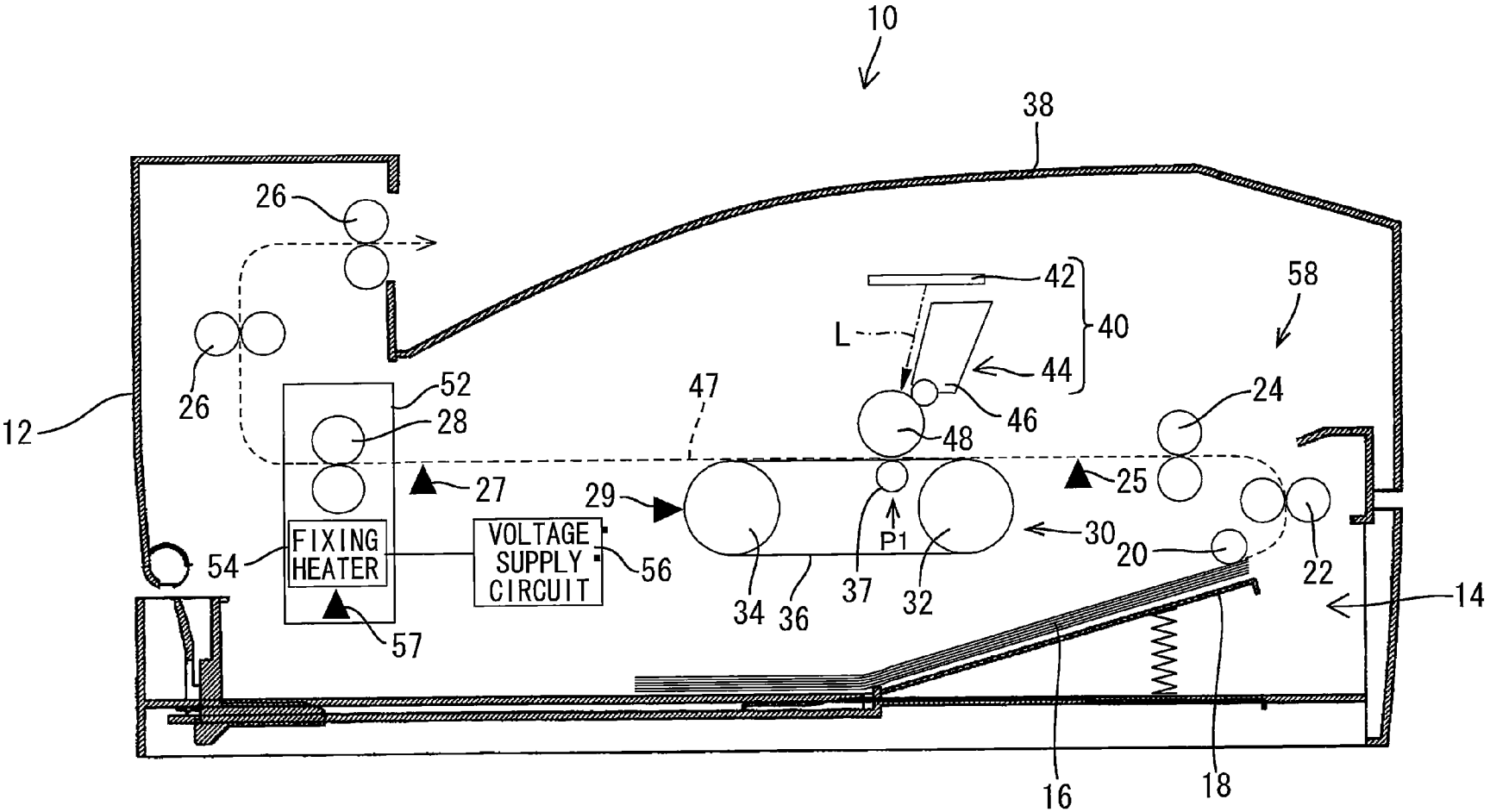
FIG. 1 is a cross-section of an printer according to a first embodiment of the invention.

FIG. 1 shows a printer 10 according to an first embodiment. The printer 10 in the embodiment is a direct transfer laser printer that functions to form images, and is an example of the image-forming device according to the present invention.

The printer 10 includes a casing 12 for accommodating the components of the printer 10. Within the casing 12, the printer 10 includes a paper tray 14, a pressing plate 18, a pickup roller 20, conveying rollers 22, registration rollers 24, an image-transferring unit 30, and an image-forming unit 40. The paper tray 14 is disposed in the bottom section of the casing 12 and accommodates stacked sheets 16 of paper or the like. The user mounts the paper tray 14 in the casing 12 after loading the paper tray 14 with sheets 16. The pressing plate 18 is disposed in the paper tray 14 for pressing the sheets 16 upward on one end so that the topmost sheet 16 is pressed against the pickup roller 20. The pickup roller 20 rotates to convey the topmost sheet 16 to the conveying rollers 22, and the conveying rollers 22 convey the sheet 16 to the registration rollers 24. After correcting skew in the sheet 16, the registration rollers 24 convey the sheet 16 to the image-transferring unit 30 and the image-forming unit 40. Together, the image-transferring unit 30 and the image-forming unit 40 are an example of the image-forming unit.

The printer 10 is also provided with a first sensor 25 downstream of the registration rollers 24. The first sensor 25 detects whether a sheet 16 is being conveyed toward the image-transferring unit 30 and the image-forming unit 40. The first sensor 25 is on when a sheet 16 is being conveyed toward the image-transferring unit 30 and the image-forming unit 40 and off when a sheet 16 is not being conveyed. The first sensor 25 is an example of the sensors according to the invention.

The image-transferring unit 30 includes a pair of support rollers 32 and 34, a belt 36, and a transfer roller 37. The belt 36 has a loop shape and is mounted around the support rollers 32 and 34. The transfer roller 37 is disposed inside the loop formed by the belt 36. The support rollers 32 and 34 are rotated counterclockwise in FIG. 1 by a motor (not shown), and the belt 36 circulates along with this rotation.

The image-forming unit 40 is disposed above the belt 36. The image-forming unit 40 includes a scanning unit 42, and a process unit 44. The scanning unit 42 is disposed above a photosensitive drum 48 (described later) of the process unit 44. A central processing unit (see FIG. 2; hereinafter "CPU") 62 described later controls the scanning unit 42 to irradiate a laser beam L over the surface of the photosensitive drum 48 based on image data transferred from a memory unit 64 (described later; see FIG. 2) that is configured of RAM, ROM, or the like.

The process unit 44 includes the photosensitive drum 48, and a developer cartridge 46. The developer cartridge 46 is filled with toner. In an image-forming operation, the scanning unit 42 irradiates the laser beam L over the surface of the photosensitive drum 48 to form an electrostatic latent image corresponding to the image being printed. Toner in the developer cartridge 46 is then supplied to the latent image to form a toner image on the surface of the photosensitive drum 48.

As the toner image formed on the surface of the photosensitive drum 48 rotates through a transfer position P1 between the photosensitive drum 48 and the belt 36, the toner image is transferred from the photosensitive drum 48 onto a sheet 16 passing through the transfer position P1. In this way, an image is formed on the sheet 16. Subsequently, the belt 36 conveys the sheet 16 to a fixing unit 52 described below.

The printer 10 further includes a second sensor 27, and a registration sensor 29. The second sensor 27 is disposed upstream of the fixing unit 52 and detects the presence of a sheet 16 being conveyed to the fixing unit 52. The second sensor 27 is on when a sheet 16 is being conveyed to the fixing unit 52 and off when a sheet 16 is not being conveyed to the fixing unit 52. The registration sensor 29 is disposed in a position for confronting the belt 36 at the support roller 34 and functions to detect toner deposited on the belt 36.

The fixing unit 52 includes a fixing heater 54, fixing rollers 28, and a temperature gauge 57. The fixing heater 54 generates heat when an AC voltage from an AC power supply 50 (see FIG. 2) is supplied to the fixing heater 54 via a voltage supply circuit 56. Heat generated by the fixing heater 54 thermally fixes the transferred image to the sheet 16. The temperature gauge 57 detects the temperature of the fixing heater 54. The fixing heater 54 is an example of the heating body and, in combination with the voltage supply circuit 56, is an example of the heating device.

Subsequently, pairs of conveying rollers 26 disposed downstream of the fixing unit 52 convey the sheet 16 out of the casing 12 and onto a discharge tray 38 provided on the top surface of the casing 12. In this way, the pickup roller 20, the conveying rollers 22, and other various rollers constitute a conveying unit 58 that serves to convey sheets 16 along a conveying path 47 that leads from the paper tray 14 to the image-transferring unit 30, the image-forming unit 40, and the fixing unit 52.

Figure 2:
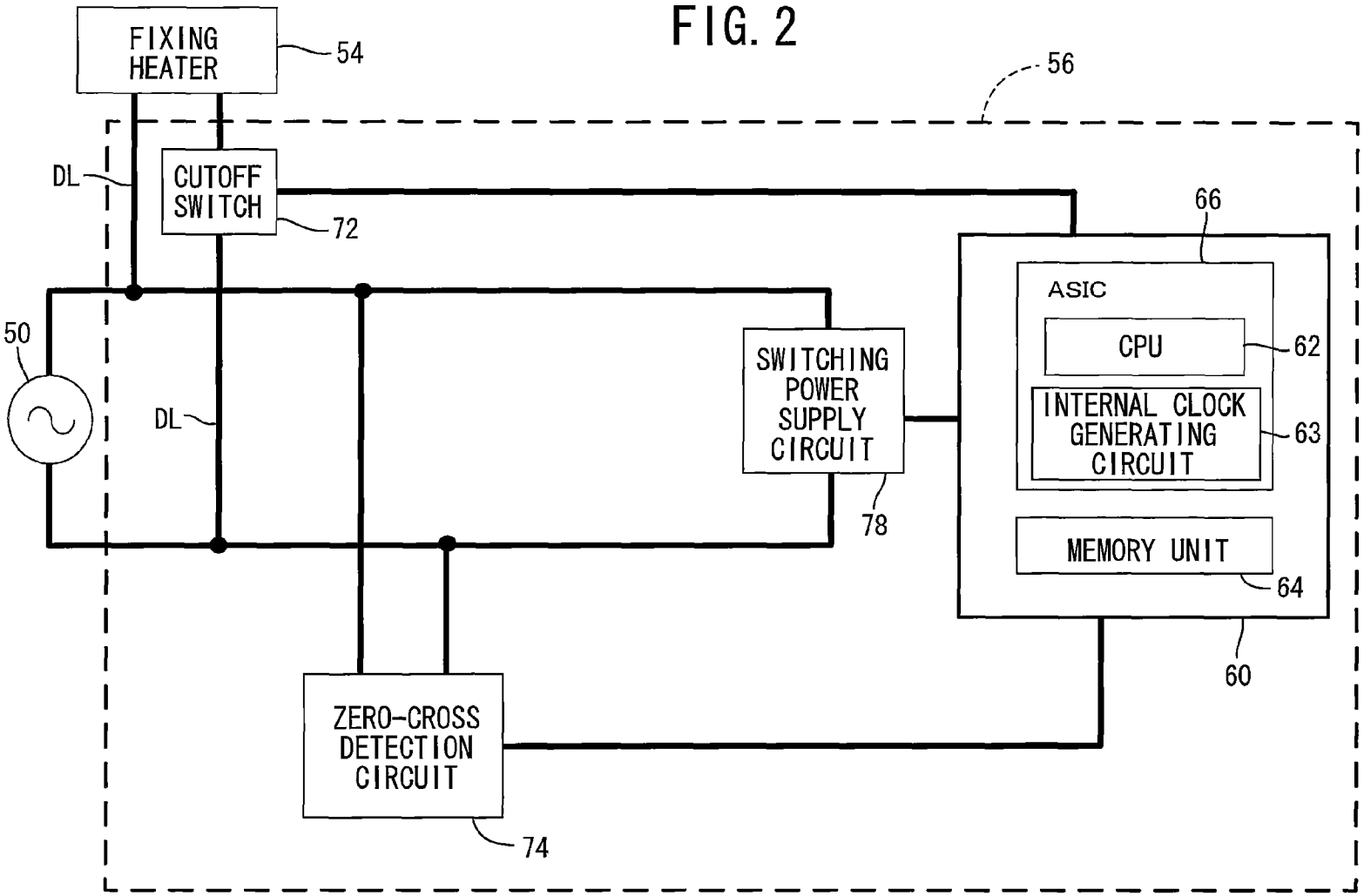
FIG. 2 is a block diagram illustrating a voltage supply circuit according to the first embodiment.

As shown in FIG. 2, the voltage supply circuit 56 includes a control circuit 60, a power cutoff switch 72, a zero-cross detection circuit 74, and a switching power supply circuit 78.

The zero-cross detection circuit 74 and the switching power supply circuit 78 in the voltage supply circuit 56 are connected in parallel to the AC power supply 50. The fixing heater 54 is also connected in parallel to these circuits through the power cutoff switch 72.

The switching power supply circuit 78 converts an AC voltage supplied from the AC power supply 50 to DC voltage to be supplied to the control circuit 60 and the like. The control circuit 60 includes an application-specific integrated circuit (ASIC) 66, and a memory unit 64. In addition to the CPU 62, the ASIC 66 includes an internal clock generation circuit 63 and other dedicated hardware circuits. The memory unit 64 stores various programs for controlling the operations of the printer 10. The CPU 62 reads programs from the memory unit 64 and controls the components of the printer 10 according to the programs. More specifically, the CPU 62 generates an internal signal NS (see FIG. 6) based on an internal clock CL (see FIG. 6) generated by the internal clock generation circuit 63 and executes an image-forming process described later. The control circuit 60 is an example of the control device.

Figure 3:
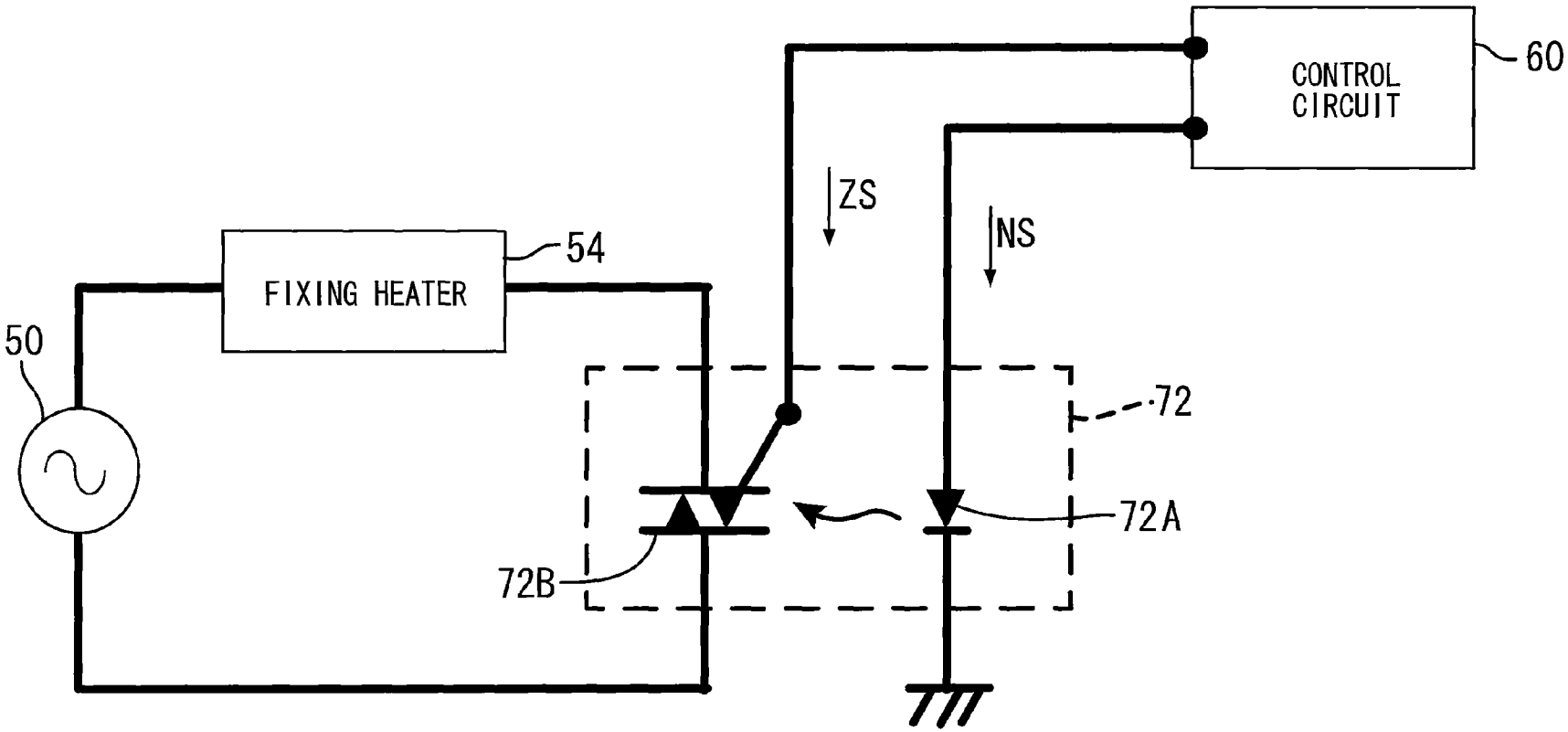
FIG. 3 is a circuit diagram illustrating a power cutoff switch according to the first embodiment.

The power cutoff switch 72 is provided on a power supply line DL via which the AC voltage of the AC power supply 50 is outputted to the fixing heater 54. The power cutoff switch 72 switches the supply of the AC voltage to the fixing heater 54 on or off based on a signal inputted from the CPU 62. More specifically, the power cutoff switch 72 is a phototriac coupler. As shown in FIG. 3, the power cutoff switch 72 includes a photodiode 72A, and a phototriac element 72B. The photodiode 72A is a light-emitting element that is connected to the control circuit 60. The phototriac element 72B is a light-receiving element that is connected to the fixing heater 54. The power supply line DL is an example of the conducting path. The power cutoff switch 72 is an example of the heating switch.

The power cutoff switch 72 is known as a zero-cross type that operates in synchronization with a zero-cross timing ZT of a zero-cross signal ZS (see FIG. 6) detected by the zero-cross detection circuit 74 and inputted into the power cutoff switch 72 via the CPU 62. More specifically, the photodiode 72A emits light based on the internal signal NS generated by the CPU 62, and the power cutoff switch 72 switches to an ON state for supplying AC voltage to the fixing heater 54 in synchronization with the zero-cross timing ZT when the zero-cross signal ZS arrives at the zero-cross timing ZT while the power cutoff switch 72 is emitting light. The power cutoff switch 72 switches to an OFF state for interrupting the supply of AC voltage to the fixing heater 54 in synchronization with the zero-cross timing ZT when the zero-cross signal ZS arrives at a zero-cross timing ZT while the photodiode 72A is not emitting light.

Returning to FIG. 2, the zero-cross detection circuit 74 detects the AC voltage outputted along the power supply line DL and generates a zero-cross signal ZS having an ON voltage while the absolute value of the AC voltage is greater than a reference value KV1 (see FIG. 6) and an OFF voltage while the absolute value is less than or equal to the reference value KV1. The zero-cross detection circuit 74 is an example of the detector.

Figure 4:
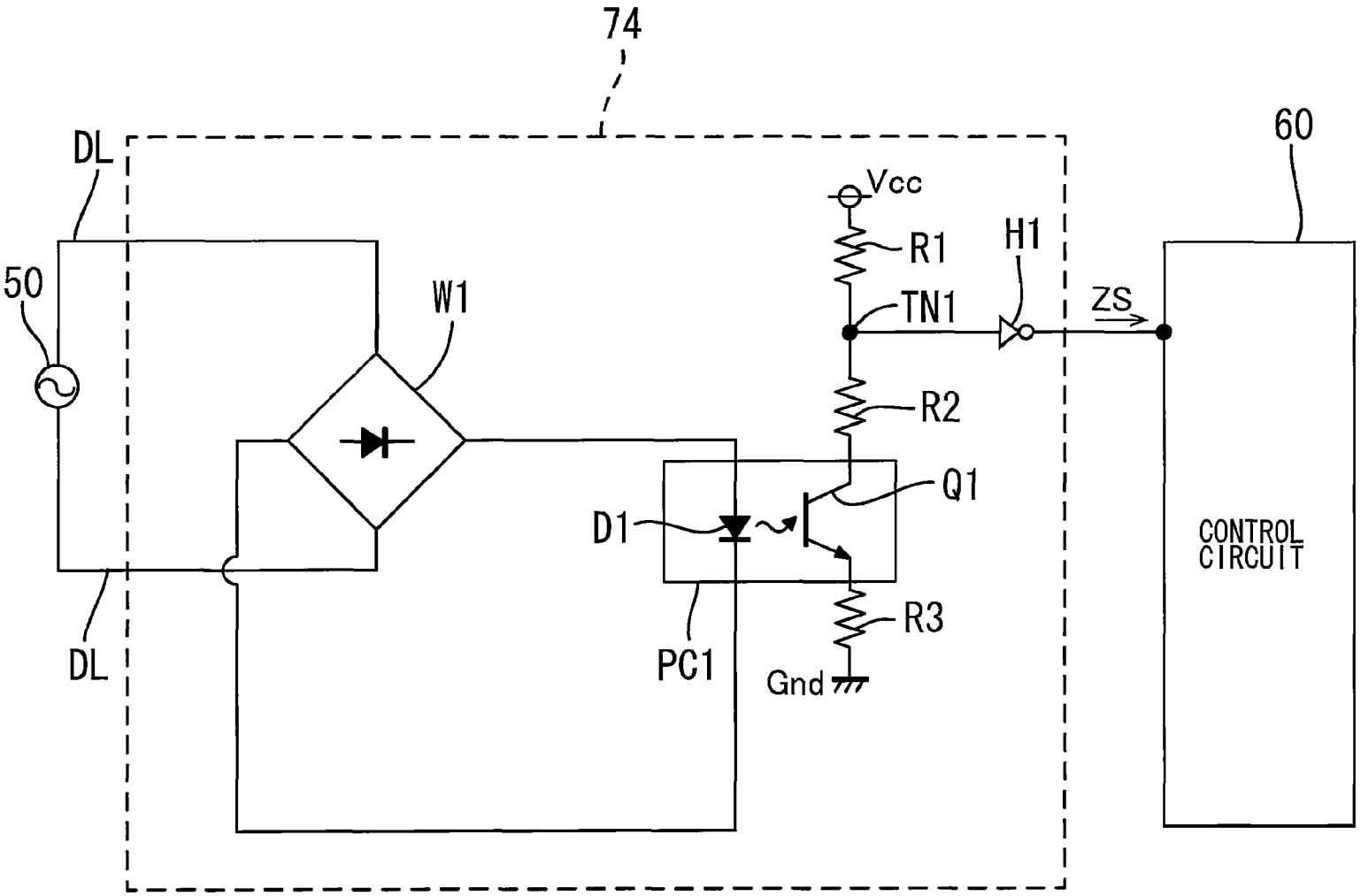
FIG. 4 is a circuit diagram illustrating a zero-cross detection circuit according to the first embodiment.

As shown in FIG. 4, the zero-cross detection circuit 74 includes a rectifier circuit W1, a photo-coupler PC1, resistors R1-R3, and an inverter circuit H1. The rectifier circuit W1 is connected to the AC power supply 50 and is a diode bridge that performs full-wave rectification of the AC voltage. The AC voltage converted by the rectifier circuit W1 is outputted to the photo-coupler PC1.

The photo-coupler PC1 includes a photodiode D1, and a phototransistor Q1. When the value of the AC voltage after undergoing full-wave rectification by the rectifier circuit W1 is greater than the reference value KV1, electric current flows to the photodiode D1, causing the photodiode D1 to emit light and the phototransistor Q1 to turn on. On the other hand, when the rectified voltage is less than or equal to the reference value KV1, electric current does not flow to the photodiode D1, turning the phototransistor Q1 off. Hence, the phototransistor Q1 is on while the value of the rectified AC voltage is greater than the reference value KV1, and off when less than or equal to the reference value KV1.

When the phototransistor Q1 of the photo-coupler PC1 turns on, current flows through the resistors R1-R3 and the phototransistor Q1, causing the voltage value at a terminal TN1 provided between the resistors R1 and R2 to drop from an ON voltage to an OFF voltage. The CPU 62 detects the voltage at the terminal TN1 via the inverter circuit H1. When the voltage value at the terminal TN1 drops from an ON voltage to an OFF voltage, the value of the voltage outputted by the inverter circuit H1 rises from an OFF voltage to an ON voltage. On the other hand, when the phototransistor Q1 turns off, current does not flow through the resistors R1-R3 and the phototransistor Q1, causing the voltage value at the terminal TN1 to rise from an OFF voltage to an ON voltage. Consequently, the voltage outputted from the inverter circuit H1 drops from an ON voltage to an OFF voltage. This configuration enables the CPU 62 to detect the zero-cross signal ZS.

When detecting the zero-cross signal ZS, the CPU 62 determines a low voltage duration of time TL (see FIG. 6) in which the voltage value is equivalent to the OFF voltage. The CPU 62 finds a center point within the low voltage duration of time TL of the zero-cross signal ZS and determines that this timing (center point) is the zero-cross timing ZT of the AC voltage.

Next, an image-forming process for forming an image on a sheet 16 will be described with reference to FIGS. 5 through 7. When the user turns on the power supply of the printer 10, the CPU 62 begins executing an image-forming process at prescribed intervals that have been predetermined. During this process, the CPU 62 executes a control process for controlling the supply of electricity to the fixing heater 54.

Figure 5:
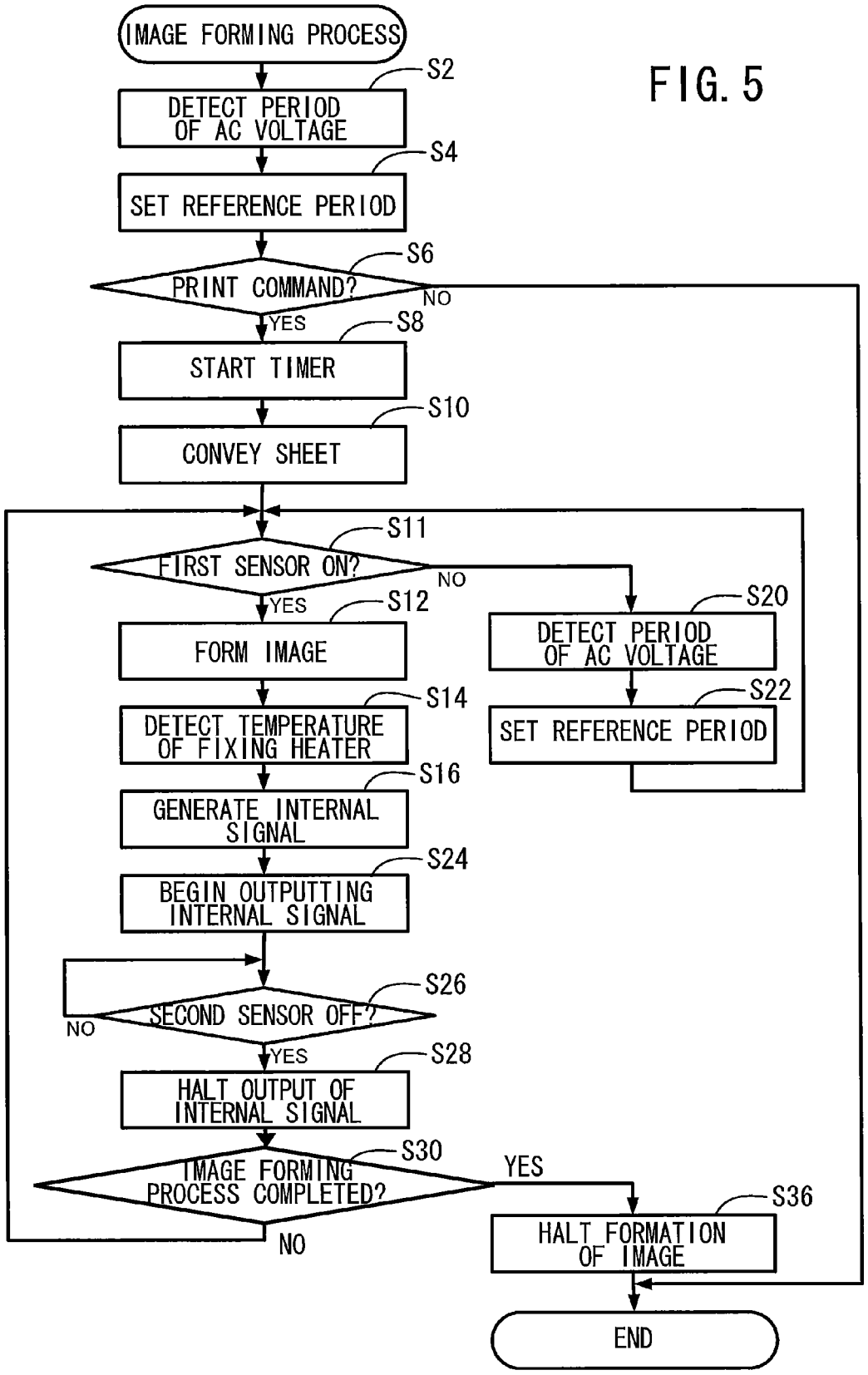
FIG. 5 is a flowchart illustrating an image forming process according to the first embodiment.

In S2 at the beginning of the image-forming process shown in FIG. 5, the CPU 62 detects the period (cycle) of the AC voltage supplied from the AC power supply 50. To determine the period of the AC voltage, the CPU 62 detects the zero-cross timing ZT using the zero-cross detection circuit 74 and multiplies the period T0 of the zero-cross timing ZT by 2. The period T0 is an example of the zero-cross-to-zero-cross period of time.

In S4 the CPU 62 sets a reference period T2 for setting a pulse pattern of the internal signal NS. The internal signal NS is a binary signal that is switched between an ON voltage for controlling the photodiode 72A of the power cutoff switch 72 to emit light, and an OFF voltage for controlling the photodiode 72A not to emit light. The CPU 62 determines the reference period T2 to be used in setting the pulse pattern of the internal signal NS, i.e., the rise time at which the internal signal NS is at the ON voltage and the fall time at which the internal signal NS is at the OFF voltage. The reference period T2 is an example of the reference period.

Specifically, the CPU 62 receives data from the internal clock generation circuit 63 indicating the period T1 of the internal clock CL and compares the period T1 of the internal clock CL to the period T0 of the zero-cross timing ZT. The CPU 62 establishes an integer N such that a multiple N of the period T1 is not an integer multiple of the period T0, and uses the multiple N of the period T1 as the reference period T2. Accordingly, the reference period T2 is set to a different interval from an integer multiple of the period T0 for the zero-cross timing ZT. Thus, the end of the interval for the reference period T2 is at a different timing than a zero-cross timing ZT when the start of the interval is synchronized with a zero-cross timing ZT, as shown in FIG. 6.

Figure 6:
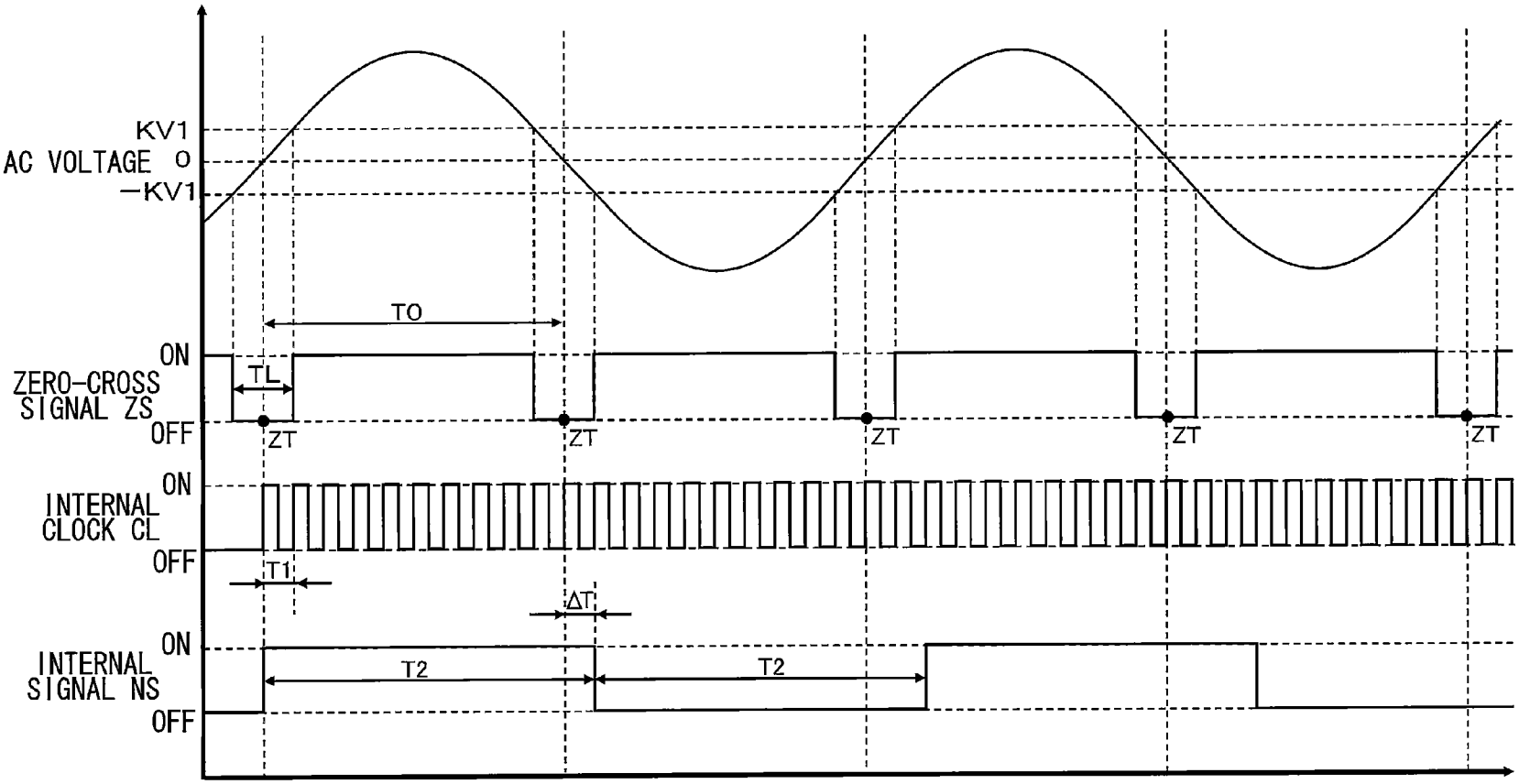
FIG. 6 is a timing chart illustrating an internal signal and a zero-cross signal according to the first embodiment.
Figure 7:
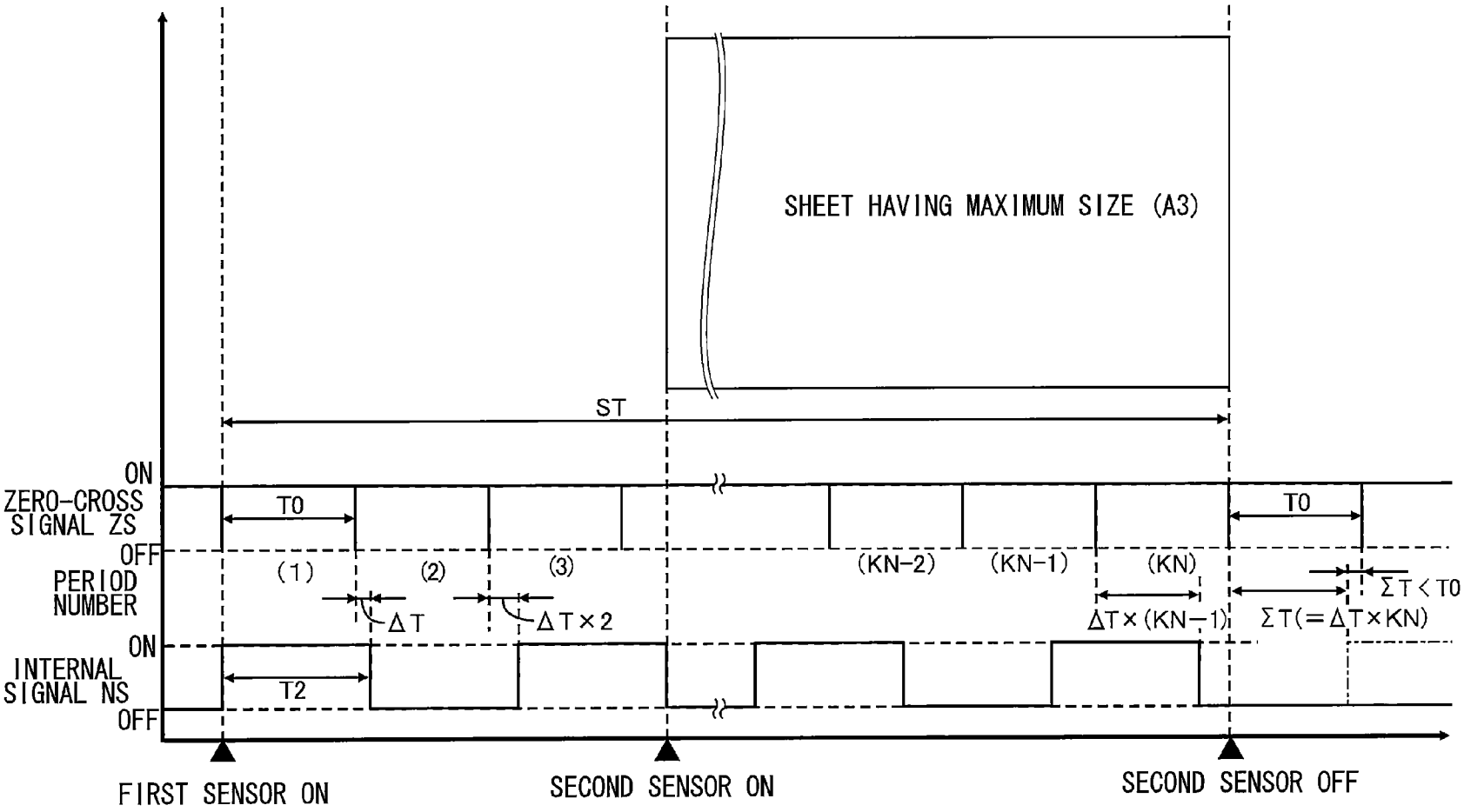
FIG. 7 is a timing chart illustrating a maximum fixing duration and a period number, and a cumulative number according to the first embodiment.

In the example of the embodiment shown in FIG. 6, the reference period T2 is set to an interval longer than the period T0 of the zero-cross timing ZT and shorter than the period of the AC voltage. As will be described later, the high level period of the internal signal NS can be set to three times the reference period T2 in the embodiment when rapidly heating the fixing heater 54. Further, the low level period of the internal signal NS can be set to three times the reference period T2 when slowly heating the fixing heater 54, such as when the temperature of the fixing heater 54 is near the target temperature. For this reason, the reference period T2 in the embodiment is set such that three times the reference period T2 is a different interval from an integer multiple of the period T0 for the zero-cross timing ZT.

In addition, the reference period T2 in the embodiment is set based on the maximum size of a sheet 16 on which the image-forming unit 40 can form images. A maximum sheet size and a maximum fixing duration ST are preset on the printer 10. The maximum sheet size is the largest sheet 16 on which the image-forming unit 40 can form an image, such as an A3-size sheet, as shown in FIG. 7. The maximum fixing duration ST is the longest duration of time that the internal signal NS must be outputted in order for the fixing unit 52 to fix an image on a sheet 16 of the maximum size, based on the conveying speed of the conveying unit 58. If a time difference ΔT is found by subtracting the period T0 of the zero-cross timing ZT from the reference period T2 (see Equation 1) and a period number KN is found by dividing the maximum fixing duration ST by the reference period T2 to indicate the number of reference periods T2 included in the maximum fixing duration ST (see Equation 2), then in the embodiment a cumulative time ΣT equivalent to the product of the time difference ΔT and period number KN is set to be shorter than the period T0 of the zero-cross timing ZT (see Equation 3).

$$\Delta T = T2 - T0 \quad \text{Equation 1}$$

$$KN = ST/T2 \quad \text{Equation 2}$$

$$T0 > \Sigma T = \Delta T \times KN \quad \text{Equation 3}$$

After setting the reference period T2 for the internal signal NS, in S6 the CPU 62 determines whether the user has inputted a print command. If a print command has not been inputted (S6: NO), the CPU 62 ends the current image-forming process.

However, if the CPU 62 determines that the user has inputted a print command (S6: YES), in S8 the CPU 62 controls the internal clock generation circuit 63 to begin outputting the internal clock CL and starts an internal timer in the CPU 62. In S10 the CPU 62 controls the conveying unit 58 to begin conveying the sheet 16. In S11 the CPU 62 determines whether the leading edge of the sheet 16 has passed the first sensor 25 based on output from the first sensor 25. While the leading edge of the sheet 16 has not passed the first sensor 25 (S11: NO), the CPU 62 again detects the period of the AC voltage in S20 similarly to S2 and sets the reference period T2 in S22 similarly to S4.

The CPU 62 may execute a measurement process prior to conveying the sheet 16 for a printing process if the condition for executing the measurement process was satisfied before the print command was inputted, for example. In the measurement process, the CPU 62 controls the image-transferring unit 30 to form a test pattern on the belt 36 and controls the registration sensor 29 to measure the test pattern. Since the sheet 16 is not being conveyed while the measurement process is being executed, the CPU 62 determines in S11 that the leading edge of the sheet 16 has not passed the first sensor 25 (S11: NO). In such a case, the CPU 62 detects the period of the AC voltage in S20 and resets (or reconfigures) the reference period T2 in S22 because the AC voltage may change while the measurement process is being executed.

When the CPU 62 determines that the trailing edge of the sheet 16 has passed the first sensor 25 (S11: YES), in S12 the CPU 62 controls the image-transferring unit 30 to form a toner image on the sheet 16 when the sheet 16 is conveyed to the transfer position P1.

In S14 the CPU 62 detects the temperature of the fixing heater 54 using the temperature gauge 57 and compares the detected temperature with the fixing temperature required for the fixing heater 54 to fix an image on the sheet 16. In S16 the CPU 62 generates an internal signal NS pattern based on the results of comparing the detected temperature to the fixing temperature.

When the difference calculated by subtracting the detected temperature from the fixing temperature is greater than a first reference temperature difference, the CPU 62 sets the pulse pattern of the internal signal NS to a pattern that is repeated every four reference periods T2 and includes an ON signal for three continuous reference periods T2 followed by an OFF signal for one reference period T2. In other words, the CPU 62 generates an internal signal NS pattern in which the high level period is three times the reference period T2 and the low level period is the reference period T2. Since the high level period is longer than the low level period in this internal signal NS pattern, the time during which AC voltage is supplied to the fixing heater 54 can be relatively long and the fixing heater 54 can be heated rapidly, as will be described later.

However, if the difference calculated by subtracting the detected temperature from the fixing temperature is less than or equal to the first reference temperature difference and greater than a second reference temperature difference that is smaller than the first reference temperature difference, the CPU 62 sets the pulse pattern of the internal signal NS to a pattern with a signal that alternates on and off for each reference period T2 as shown in FIG. 6. In other words, the CPU 62 generates an internal signal NS pattern in which both the high level period and the low level period are the reference period T2.

Additionally, if the difference calculated by subtracting the detected temperature from the fixing temperature is less than or equal to the second reference temperature difference, the CPU 62 sets the pulse pattern of the internal signal NS to a pattern that is repeated every four reference periods T2 and includes an ON signal for one reference period T2 followed by an OFF signal for three continuous reference periods T2. In other words, the CPU 62 generates an internal signal NS pattern in which the high level period is the reference period T2 and the low level period is three times the reference period T2. Since the low level period is longer than the high level period in this internal signal NS pattern, the time for supplying an AC voltage to the fixing heater 54 can be relatively short so that the fixing heater 54 can be heated slowly, as will be described later.

In S24 the CPU 62 begins outputting the internal signal NS. As described above, when the zero-cross signal ZS reaches the zero-cross timing ZT during a high level period of the internal signal NS, the power cutoff switch 72 either begins to supply an AC voltage to the fixing heater 54 in synchronization with the zero-cross timing ZT or maintains the current status of the AC voltage supply. When the zero-cross signal ZS arrives at the zero-cross timing ZT during a low level period of the internal signal NS, the power cutoff switch 72 either interrupts the supply of the AC voltage to the fixing heater 54 in synchronization with the zero-cross timing ZT or maintains the interrupted status of the AC voltage supply. In other words, the CPU 62 uses wavenumber control to control the fixing heater 54 based on the AC voltage.

As shown in FIG. 6, in the embodiment, the initial rise timing of the internal signal NS is set to be synchronized with the zero-cross timing ZT. Because the high level period and low level period of the internal signal NS are generated as integer multiple of the reference period T2. Here, the reference period T2 is defined so as to satisfy the equations 1-3. Accordingly, except the initial rise timing of the internal signal NS, the rise timing and fall timing of the internal signal NS are not coincide with the zero-cross timing ZT at least in a maximum fixing duration ST starting from the initial rise timing of the internal signal NS.

After initiating output of the internal signal NS, in S26 the CPU 62 determines whether the trailing edge of the sheet 16 has passed over the second sensor 27 based on output from the second sensor 27. Hence, after the second sensor 27 turns on, the CPU 62 waits while the second sensor 27 remains on (S26: NO). When the second sensor 27 turns off (S26: YES), in S28 the CPU 62 halts output of the internal signal NS to interrupt the AC voltage supply to the fixing heater 54.

In S30 the CPU 62 determines whether the image-forming process has been completed. If the CPU 62 determines based on the print command that the image-forming process has not been completed, such as when the inputted print command specifies a plurality of sheets 16 but only one sheet 16 has undergone image formation (S30: NO), then the CPU 62 returns to S11 and prepares to form an image on the next sheet 16.

When a plurality of sheets 16 is conveyed in succession, the CPU 62 provides a prescribed gap between each pair of consecutively conveyed sheets 16 to ensure that the sheets 16 do not overlap. Since the first sensor 25 is off during the gaps between consecutively conveyed sheets 16, the CPU 62 can use this interval in which the first sensor 25 is off to execute the processes in S20 and S22. If a measurement condition is satisfied during an image-forming operation, the CPU 62 may execute a measurement process after completing image formation on one sheet 16 and prior to conveying the next sheet 16, for example. The CPU 62 executes the processes in S20 and S22 while this measurement process is being executed.

When the CPU 62 determines that the image-forming process has been completed for the sheets 16 indicated in the print command (S30: YES), in S36 the CPU 62 controls the image-transferring unit 30 to halt the formation of toner images and conveyance of the sheet, ending the current image-forming process.

(1) In the printer 10 according to the embodiment, the power cutoff switch 72 is a zero-cross type phototriac coupler that is used to switch the supply of AC voltage to the fixing heater 54 on and off. The power cutoff switch 72 switches the AC voltage supply on or off based on the status of the internal signal NS at the zero-cross timing ZT. In the embodiment, at least one of the rise timing and fall timing of the internal signal NS is set different from the zero-cross timings ZT. Accordingly, the status of the internal signal NS at a zero-cross timing ZT can be clearly discerned, reducing the likelihood of any variations in the results of determining whether or not to supply AC Voltage to the fixing heater 54. Thus, this configuration can suppress instability in temperature control for the fixing heater 54.

(2) More specifically, the reference period T2 used to set the high level period and low level period of the internal signal NS are set to an interval different from the period T0 of the zero-cross timings ZT. Therefore, when the rise timing of the internal signal NS is synchronized with the zero-cross timing ZT, for example, the fall timing of the internal signal NS will differ from the zero-cross timing ZT and, in most cases, both the rise timings and fall timings will come at different timings than the zero-cross timing ZT.

(3) In the printer 10 of the embodiment, the reference period T2 is set longer than the period T0 of the zero-cross timings ZT. Since the printer 10 performs temperature control to raise the temperature of the fixing heater 54 to a fixing temperature, it is preferable to use a method of control that can increase the temperature more rapidly. By setting the reference period T2 longer than the period T0 of the zero-cross timings ZT, the printer 10 can more rapidly increase the temperature of the fixing heater 54 than when the reference period T2 is set shorter than the period T0 of the zero-cross timings ZT.

(4) In the printer 10 of the embodiment, the reference period T2 is set based on the maximum size of a sheet 16 on which the image-forming unit 40 can form images. Specifically, if the cumulative time ΣT is the accumulation of time differences AT, denoting the difference between the reference period T2 and the period T0 of the zero-cross timing ZT, over the maximum fixing duration ST for a maximum size sheet 16, the reference period T2 is set such that the cumulative time ΣT is shorter than the period T0 of the zero-cross timing ZT. This arrangement keeps the rise timing or fall timing of the internal signal NS from coinciding with a zero-cross timing ZT less than or equal to one time while an image is being fixed on the sheet 16, thereby suppressing instability in temperature control for the fixing heater 54.

When the initial rise timing of the internal signal NS is synchronized with the zero-cross timing ZT as in the example of FIG. 6, temperature control of the fixing heater 54 can be particularly unstable at the starting point of heating the fixing heater 54 prior to fixing an image on the sheet 16. Such instability can produce blemishes on the sheet 16 when occurring during the fixing process. However, after the process for fixing an image on the sheet 16 has begun, the rise timings and fall timings of the internal signal NS will not coincide with the zero-cross timing ZT. Accordingly, the configuration of the embodiment reduces instability in temperature control for the fixing heater 54 while an image is being fixed on the sheet 16.

(5) If the supply of AC voltage to the fixing heater 54 is interrupted during the conveying period for conveying the sheets 16 (i.e., between the start and end of the conveying period), the printer 10 of the embodiment regenerates (or reconfigures) the internal signal NS. By updating the internal signal NS in response to changes in environmental conditions within the device, such as temperature and humidity, the printer 10 can better control the temperature of the fixing heater 54 with consideration for its environment than when continuing to use the same internal signal NS set at the start of the image-forming process.

Second Embodiment

Next, a second embodiment of the present invention will be described with reference to FIGS. 8 and 9. The second embodiment differs from the first embodiment in that the zero-cross detection circuit 74 has a switch 74A for toggling on and off the AC voltage supply to the zero-cross detection circuit 74. The following description will focus on points of difference from the first embodiment, wherein like parts and components are designated with the same reference numerals to avoid duplicating description.

Figure 8:
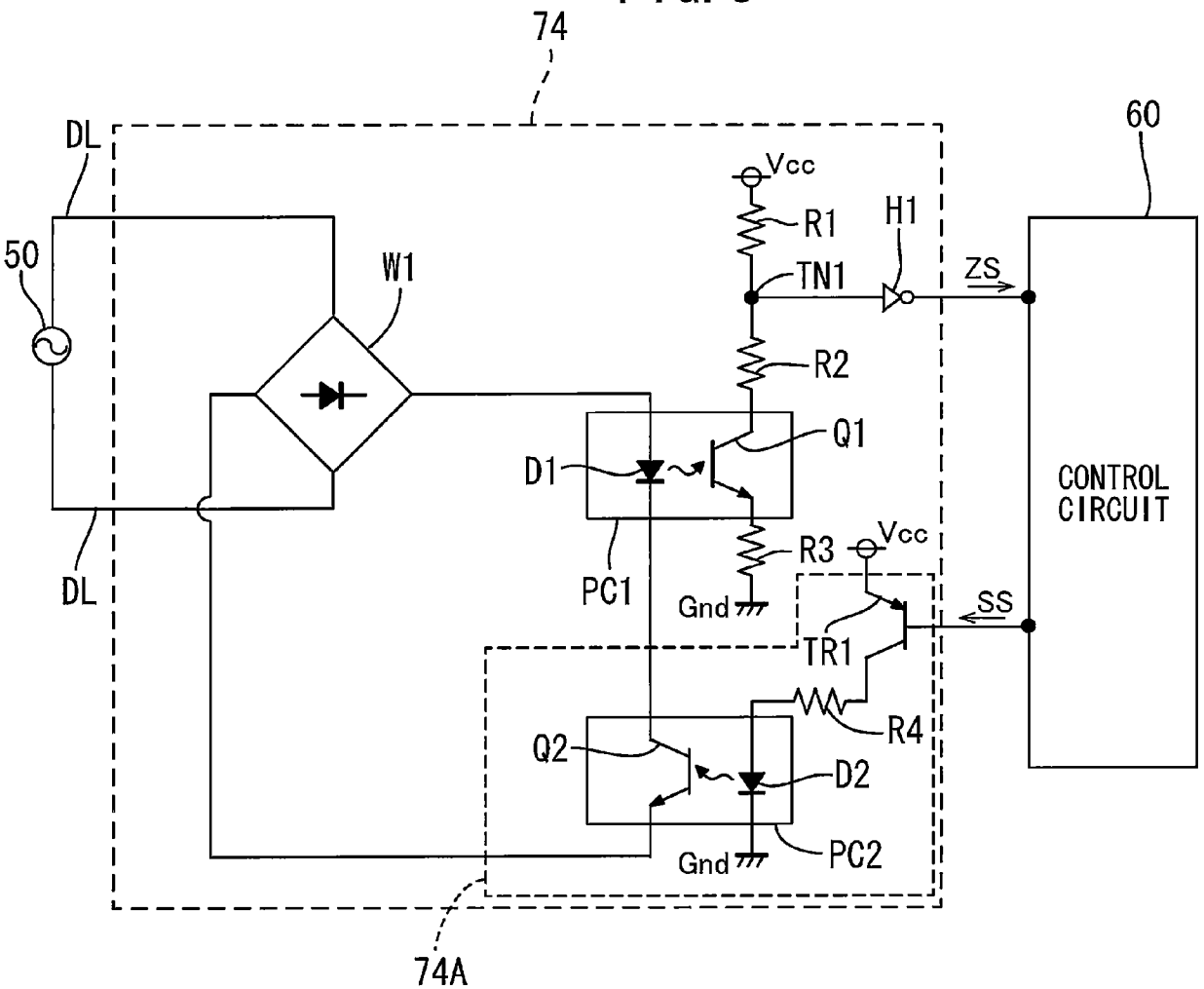
FIG. 8 is a circuit diagram illustrating a zero-cross detection circuit according to a second embodiment.

As shown in FIG. 8, the zero-cross detection circuit 74 according to the second embodiment has a structure similar to the zero-cross detection circuit 74 according to the first embodiment, but also includes the switch 74A. The switch 74A is an example of the detecting switch.

The switch 74A includes a photo-coupler PC2, a resistor R4, and a transistor TR1. The photo-coupler PC2 further includes a photodiode D2, and a phototransistor Q2. The photodiode D2 is connected to the transistor TR1 via the resistor R4. The phototransistor Q2 is provided on a closed circuit along which AC voltage is supplied after full rectification by the rectifier circuit W1. The rectified AC voltage is supplied to the photodiode D1 of the photo-coupler PC1 via the phototransistor Q2.

The CPU 62 outputs a control signal SS to the transistor TR1. When the transistor TR1 is turned on by the control signal SS, electric current flows to the photodiode D2, causing the photodiode D2 to emit light and the phototransistor Q2 to turn on. On the other hand, when the transistor TR1 is turned off by the control signal SS outputted from the CPU 62, the electric current does not flow to the photodiode D2, turning the phototransistor Q2 off.

When the phototransistor Q2 of the photo-coupler PC2 is on, the AC voltage fully rectified by the rectifier circuit W1 is supplied to the photo-coupler PC1 through the phototransistor Q2, enabling the CPU 62 to detect the zero-cross signal ZS. On the other hand, when the phototransistor Q2 is off, the voltage supply to the photo-coupler PC1 is interrupted, and the CPU 62 is unable to detect the zero-cross signal ZS. Hence, the switch 74A functions to switch on and off the supply of AC voltage to the zero-cross detection circuit 74 based on the control signal SS outputted from the CPU 62.

Figure 9:
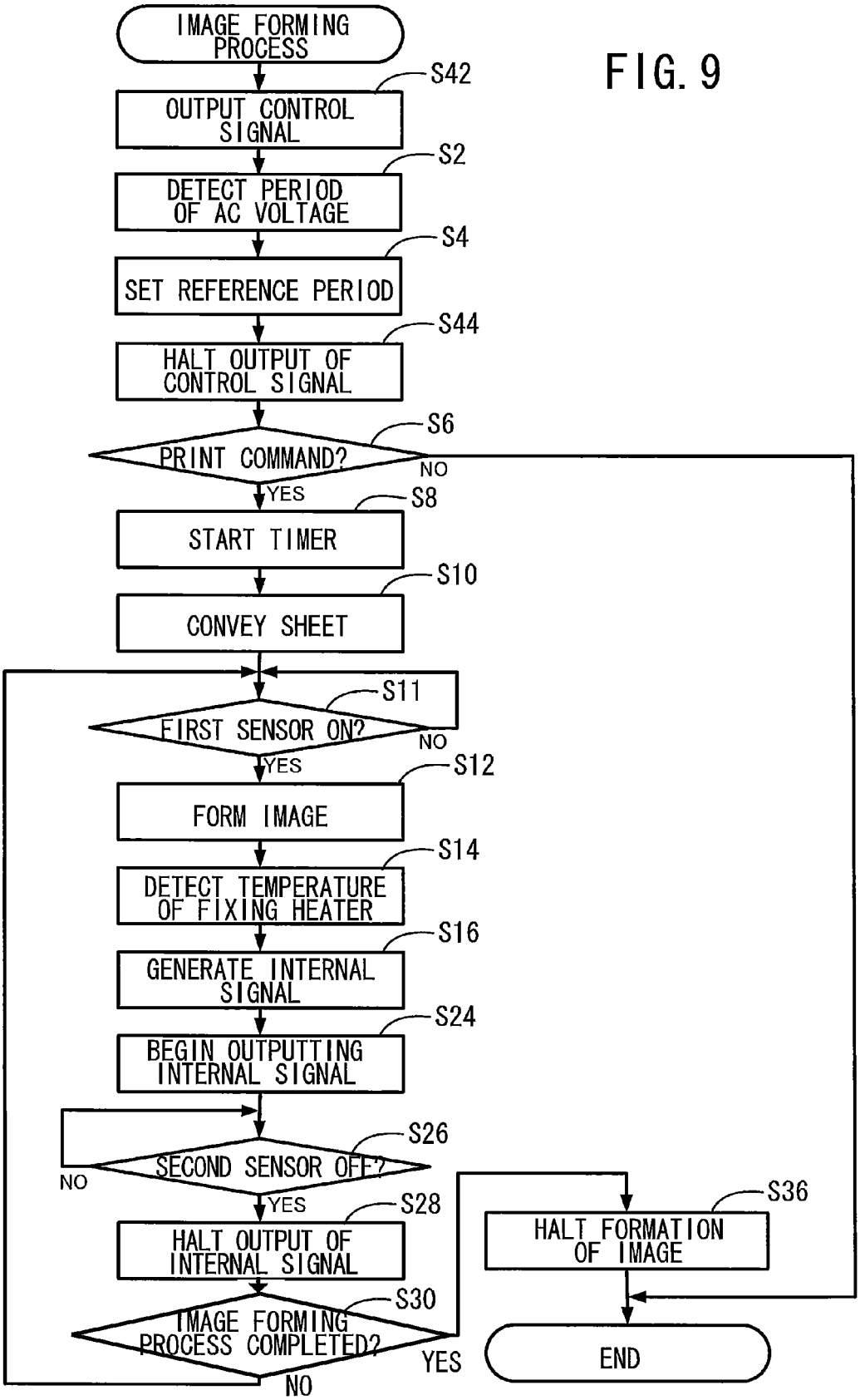
FIG. 9 is a flowchart illustrating an image forming process according to the second embodiment.

In S42 at the beginning of the image-forming process shown in FIG. 9, the CPU 62 begins outputting the control signal SS to the transistor TR1 of the switch 74A shown in FIG. 8. Initially, the control signal SS is an ON voltage for turning on the transistor TR1. With this configuration, when an AC voltage is first supplied to the zero-cross detection circuit 74, in S2 the CPU 62 detects the period of the AC voltage by detecting the zero-cross timing ZT using the zero-cross detection circuit 74. In S4 the CPU 62 sets the reference period T2 of the internal signal NS based on the period of the detected AC voltage.

After detecting the period of the AC voltage and setting the reference period T2 for the internal signal NS, in S44 the CPU 62 enters a standby state to stand ready to detect the period of the AC voltage, and halts output of the control signal SS to the transistor TR1. That is, the CPU 62 outputs an OFF voltage to the transistor TR1 of the switch 74A for turning off the transistor TR1. Turning off the transistor TR1 interrupts the supply of AC voltage to the zero-cross detection circuit 74.

In other words, the CPU 62 begins outputting the control signal SS to the transistor TR1 prior to detecting the period of the AC voltage and stops outputting the control signal SS to the transistor TR1 after the period has been detected. The CPU 62 repeatedly switches the output status of the control signal SS each time the period of the AC voltage is detected.

The printer 10 according to the second embodiment described above interrupts the AC voltage supply to the zero-cross detection circuit 74 during a standby state in which the CPU 62 waits to detect the period of the AC voltage. With this configuration, the printer 10 can reduce power consumption in the zero-cross detection circuit 74 during the standby state.

Third Embodiment

Next, a third embodiment of the present invention will be described with reference to FIGS. 10 through 12. The third embodiment differs from the first embodiment in that the pattern of the internal signal is generated based on a peak detection signal PS. The following description will focus on points of difference from the first embodiment, wherein like parts and components are designated with the same reference numerals to avoid duplicating description.

Figure 10:
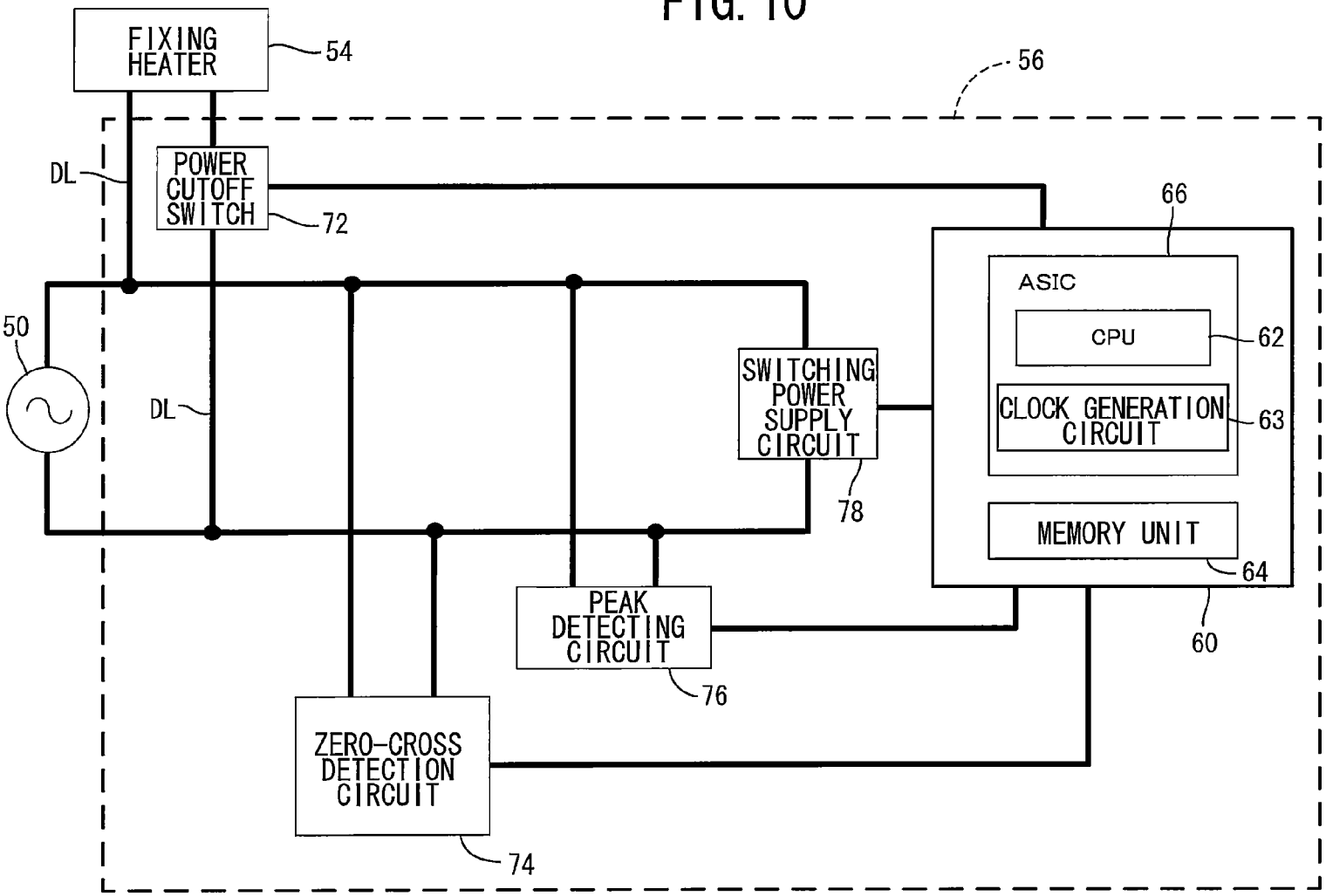
FIG. 10 is a block diagram illustrating a voltage supply circuit according to a third embodiment.

As shown in FIG. 10, the voltage supply circuit 56 according to the third embodiment has a similar configuration to the voltage supply circuit 56 according to the first embodiment, but also includes a peak-detecting circuit 76. The peak-detecting circuit 76 in the voltage supply circuit 56 and the fixing heater 54 via the power cutoff switch 72 are connected in parallel to the AC power supply 50.

Figure 12:
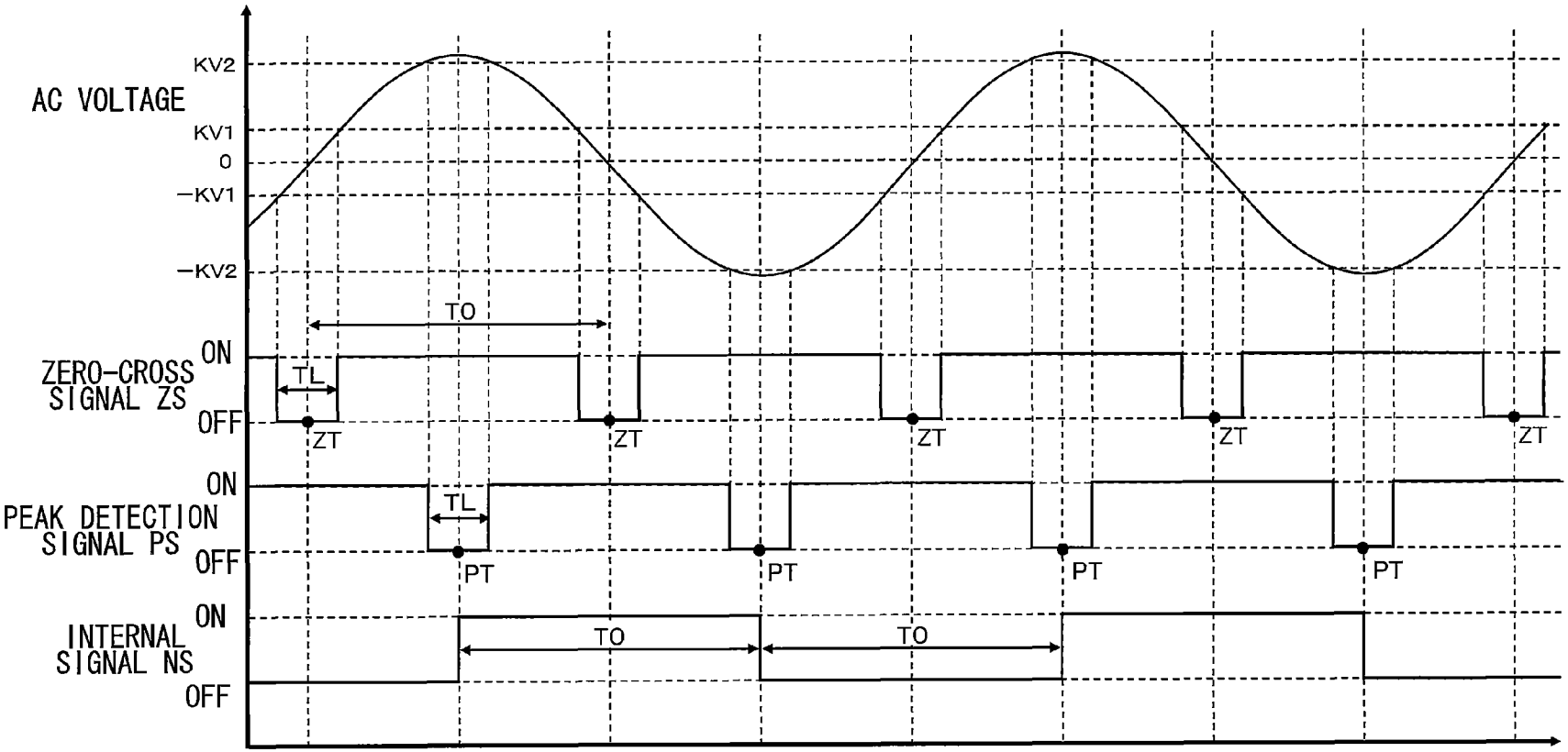
FIG. 12 is a timing chart illustrating an internal signal and a zero-cross signal according to the third embodiment.

The peak-detecting circuit 76 detects the AC voltage outputted on the power supply line DL and generates a peak detection signal PS (see FIG. 12). The peak detection signal PS includes an OFF voltage in intervals where the absolute value of the detected AC voltage is greater than a reference value KV2 set greater than the reference value KV1 (see FIG. 12) and an ON voltage in intervals where the absolute value of the detected AC voltage is less than or equal to the reference value KV2.

While not diagramed in FIG. 10, the peak-detecting circuit 76 is configured similarly to the zero-cross detection circuit 74 shown in FIG. 4, excluding the inverter circuit H1. In addition, the resistors R1-R3 connected in series to the phototransistor Q1 in the peak-detecting circuit 76 have different resistance values than in the zero-cross detection circuit 74. As a result, the peak detection signal PS detected by the CPU 62 is an OFF voltage when the value of the fully-rectified AC voltage is greater than the reference value KV2, which is larger than the reference value KV1, and is an ON voltage when the value of the fully-rectified AC voltage is less than or equal to the reference value KV2. By detecting the peak detection signal PS, the CPU 62 detects the low voltage duration of time TL in which the voltage value is equivalent to the OFF voltage. The CPU 62 finds a center point within the low voltage duration of time TL of the peak detection signal PS and determines that this timing is a peak timing PT of the AC voltage.

Figure 11:
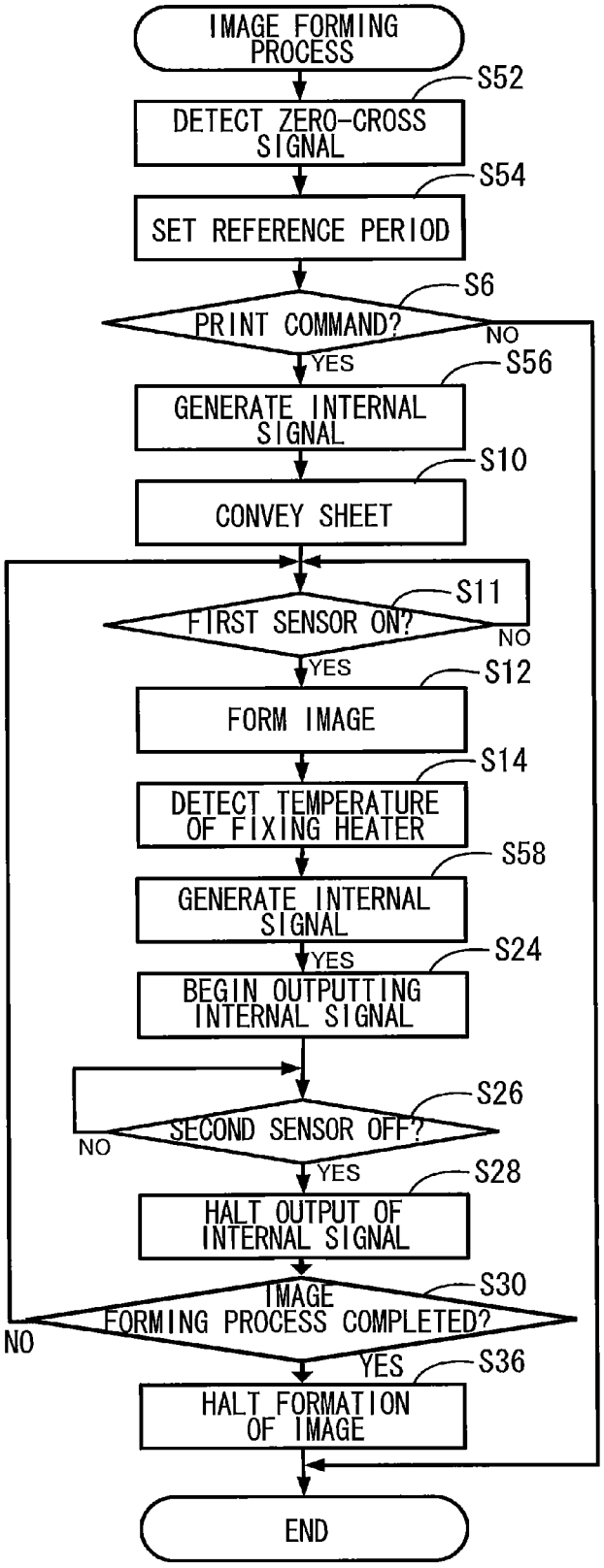
FIG. 11 is a flowchart illustrating an image forming process according to the third embodiment.

In S52 at the beginning of the image-forming process shown in FIG. 11, the CPU 62 detects the zero-cross signal ZS using the zero-cross detection circuit 74 and determines the zero-cross timing ZT of the zero-cross signal ZS. In S54 the CPU 62 sets the reference period T2 of the internal signal NS. Specifically, the CPU 62 detects the peak timing PT using the peak-detecting circuit 76 and sets the reference period T2 to the period T0 of the peak timing PT.

If the CPU 62 determines in S6 that the user has inputted a print command (S6: YES), then in S56 the CPU 62 generates an internal signal NS pattern. The CPU 62 generates this pattern based on the peak timings PT. Specifically, the CPU 62 generates an internal signal NS pattern in which the high level period and low level period of the internal signal NS are integer multiples of the period T0 and the rise timing and fall timing of these periods coincides with a peak timing PT. Subsequently, in S24-S28 the CPU 62 controls the AC voltage supply to the fixing heater 54 based on the internal signal NS having the pattern established above. In S58 the CPU 62 performs the same process with S56.

The printer 10 according to the third embodiment sets the rise timing and fall timing of the internal signal NS shifted from the zero-cross timings by one-fourth the period of the AC voltage, i.e., half the period of the zero-cross timings ZT. With this configuration, the printer 10 can clearly discern the status of the internal signal NS at each zero-cross timing ZT to suppress any variation in results of determining whether to supply AC voltage to the fixing heater 54. Accordingly, the printer 10 can suppress instability in temperature control for the fixing heater 54.

While the invention has been described in detail with reference to the embodiments thereof, it would be apparent to those skilled in the art that various changes and modifications may be made therein without departing from the scope of the invention.

(1) In the embodiments, the device having a printing function (that is, the printer 10) is explained as an example of the present invention. However, the present invention is applicable to other devices such as a multifunction peripheral having a scanner function and facsimile function in addition to the printing function. The present invention can be applied to a wide variety of devices that control the supply of electricity to heating bodies, such as the fixing heater 54, during processes.

(2) In the embodiments, the control device 60 includes the ASIC 66 and the ASIC 66 includes the CPU 62. The CPU 62 executes the image forming process or other processes by using hardware included in the ASIC 66 if needed. However, the control device 60 may include a CPU different from the ASIC 66, and this CPU executes each process. Alternatively, the ASIC 66 may not include the CPU 62 and hardware included in the ASIC h66 may execute each process. Further, one CPU, a plurality of CPUs, one ASIC, or a plurality of ASICs may be included in the control device 60 and execute each process.

(3) The programs executed by the CPU 62 need not be stored in the memory unit 64, but may be stored in the ASIC 66 or another storage device.

(4) The first embodiment describes an example of setting the reference period T2 for the internal signal NS based on the maximum size of a sheet 16 on which the image-forming unit 40 can form images, but the present invention is not limited to this configuration. For example, if a particular size of sheet 16, such as the A4-size sheet, is imagined to be the most frequently used size when forming images, the reference period T2 of the internal signal NS may be determined based on the size of this sheet 16. Further, it is not necessary for the reference period T2 to be set based on the size of a sheet 16.

(5) In the example of the first embodiment, the reference period T2 is set to an interval longer than the period T0 of the zero-cross timings ZT, but the reference period T2 may be set to a shorter interval than the period T0 instead.

(6) The reference period T2 may also be set equivalent to the period T0 of the zero-cross timings ZT, as in the third embodiment. It is not necessary that the reference period T2 be set to an interval different from the period T0, provided that the rise timing and fall timing of the internal signal NS can be set to a different timing than the zero-cross timings ZT, such as a timing between the peak timings PT and the zero-cross timings ZT. One example of this timing is an intermediate timing between the peak timings PT and the zero-cross timings ZT.

(7) In the examples of the second and third embodiments, the internal signal NS is not regenerated during the image-forming process, but the internal signal NS may be regenerated (that is, the processes S20 and S22 are executed) during the image-forming process as described in the first embodiment.

What is claimed is:

1. A heating device comprising:

a heating body configured to be connected to an AC power source and generate heat by power supplied from the AC power source;

a heating switch configured to be connected between the AC power source and the heating body and configured to switch supply of the power from the AC power source to the heating body;

a detector configured to detect AC voltage of the AC power source; and a control device configured to:

detect a zero-cross timing of the AC voltage by using the detector;

generate a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and control the heating switch to perform a switching action in which the heating switch is rendered on when the zero-cross timing is detected during the high level period of time and rendered off when the zero-cross timing is detected during the low level period of time, wherein the control device generates the signal such that a duration of time between two successive zero-cross timings is different from one of the high level period of time and the low level period of time.

2. The heating device according to claim 1, wherein the control device generates the signal such that the high level period of time is longer than the duration of time.

3. The heating device according to claim 1, wherein the control device generates the signal such that the rising transition is set to be in coincidence with one of a maximum voltage and a minimum voltage of the AC voltage, and the falling transition is set to be in coincidence with remaining one of the maximum voltage and the minimum voltage of the AC voltage.

4. The heating device according to claim 1, wherein when generating the signal, the control device is further configured to generate a signal pattern having the high level period of time, the low level period of time, the rising transition changing from the low level to the high level, and the falling transition changing from the high level to the low level, the signal pattern being such a form that at least one of the rising transition and the falling transition is to be in incoincidence with a zero-cross timing of the AC voltage, wherein the signal is generated on a basis of the generated signal pattern.

5. The heating device according to claim 1, wherein the control device is further configured to determine the duration of time by using the detector.

6. An image forming device comprising:

an image forming unit configured to print an image on a sheet; and a fixing device configured to fix the image on the sheet, the fixing device comprising a heating body configured to be connected to an AC power source and generate heat by power supplied from the AC power source;

a heating switch connected between the AC power source and the heating body and configured to switch supply of the power from the AC power source to the heating body;

a detector configured to detect AC voltage of the AC power source; and a control device configured to:

detect a zero-cross timing of the AC voltage by using the detector;

generate a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and control the heating switch to perform a switching action in which the heating switch is rendered on when the zero-cross timing is detected during the high level period of time and rendered off when the zero-cross timing is detected during the low level period of time, wherein the control device generates the signal such that a duration of time between two successive zero-cross timings is different from one of the high level period of time and the low level period of time.

7. The image forming device according to claim 6, wherein the image forming unit is capable of printing the image on the sheet up to a prescribed maximum size, and the fixing device is capable of fixing an image on the sheet having the maximum size during a maximum fixing duration of time, wherein the control device is further configured to:

determine a zero-cross-to-zero-cross duration of time between two successive zero-cross timings by using the detector;

set a reference period of time such that a product of a first value and a second value is shorter than the zero-cross duration of time, the first value being obtained by dividing a maximum fixing duration of time by the reference period of time, the second value being a time difference between the zero-cross-to-zero-cross duration of time and the reference period of time, the reference period of time being used when the signal is generated.

8. The image forming device according to claim 6, further comprising:

a conveying unit configured to convey the sheet to the fixing device via the image forming unit; and a sensor configured to detect a sheet at the fixing device, wherein the control device is further configured to:

control the conveying unit to convey the sheet; and acquire a detection result from the sensor, wherein the control device is configured to execute the switching action when the control device acquires the detection result indicating that the sheet is detected whereas the control device is configured to stop the switching action by interrupting power from the AC power source to the heating device when the control device acquires the detection result indicating that sheet is absent, wherein the control device is further configured to reconfigure the signal when the switching action is stopped and the conveying unit conveys the sheet.

9. The image forming device according to claim 8, further comprising a detection switch through which the sensor is connected to the AC power source, the detection switch switching supply of power from the AC power source to the sensor, wherein the detection switch is rendered on when the sensor detects the sheet whereas the detection switch is rendered off when the sensor does not detect the sheet.

10. The image forming device according to claim 6, wherein when generating the signal, the control device is further configured to generate a signal pattern having the high level period of time, the low level period of time, the rising transition changing from the low level to the high level, and the falling transition changing from the high level to the low level, the signal pattern being such a form that at least one of the rising transition and the falling transition is to be in incoincidence with a zero-cross timing of the AC voltage, wherein the signal is generated on a basis of the generated signal pattern.

11. The image forming device according to claim 6, wherein the control device is further configured to determine the duration of time by using the detector.

12. A method for controlling a heating device including: a heating body configured to be connected to an AC power source and generate heat by power supplied from the AC power source; a heating switch configured to be connected between the AC power source and the heating body and configured to switch supply of the power from the AC power source to the heating body; and a detector configured to detect AC voltage of the AC power source, the method comprising:

detecting a zero-cross timing of the AC voltage by using the detector;

generating a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and controlling the heating switch to perform a switching action in which the heating switch is rendered on when the zero-cross timing is detected during the high level period of time and rendered off when the zero-cross timing is detected during the low level period of time, wherein the signal is generated such that a duration of time between two successive zero-cross timings is different from one of the high level period of time and the low level period of time.

13. The method according to claim 12, wherein the signal is generated such that the high level period of time is longer than the duration of time.

14. The method according to claim 12, wherein the signal is generated such that the rising transition is set to be in coincidence with one of a maximum voltage and a minimum voltage of the AC voltage, and the falling transition is set to be in coincidence with the remaining one of the maximum voltage and the minimum voltage of the AC voltage.

15. The method according to claim 12, the method being for further controlling an image forming unit that is capable of printing an image on a sheet up to a prescribed maximum size, wherein the fixing device is capable of fixing an image on the sheet having the maximum size during a maximum fixing duration of time, the method further comprising:

determining a zero-cross-to-zero-cross duration of time between two successive zero-cross timings by using the detector; and setting a reference period of time such that a product of a first value and a second value is shorter than the zero-cross duration of time, the first value being obtained by dividing the maximum fixing duration of time by the reference period of time, the second value being a time difference between the zero-cross-to-zero-cross duration of time and the reference period of time, the reference period of time being used when the signal pattern is generated.

16. The method according to claim 12, the method being for further controlling:

a conveying unit configured to convey the sheet to the fixing device via the image forming unit; and a sensor configured to detect a sheet at the fixing device, the method further comprising:

controlling the conveying unit to convey the sheet; and acquiring a detection result from the sensor, wherein the switching action is executed when acquiring the detection result indicating that the sheet is detected, the method further comprising:

stopping the switching action by interrupting power from the AC power source to the heating device when acquiring the detection result indicating that sheet is absent; and reconfiguring the signal when the switching action is stopped and the conveying unit conveys the sheet.

17. The method according to claim 16, the method being for further controlling a detection switch through which the sensor is connected to the AC power source, the detection switch switching supply of power from the AC power source to the sensor, the method further comprising:

turning on the detection switch when the sensor detects the sheet; and turning off the detection switch when the sensor does not detect the sheet.

18. The method according to claim 12, wherein the generating includes generating a signal pattern having the high level period of time, the low level period of time, the rising transition changing from the low level to the high level, and the falling transition changing from the high level to the low level, the signal pattern being such a form that at least one of the rising transition and the falling transition is to be in incoincidence with a zero-cross timing of the AC voltage, wherein the signal is generated on a basis of the generated signal pattern.

19. The method according to claim 12, further comprising determining the duration of time by using the detector.

20. A non-transitory computer readable storage medium storing a set of program instructions installed on and executed by a computer for controlling a heating device including: a heating body configured to be connected to an AC power source and generate heat by power supplied from the AC power source; a heating switch configured to be connected between the AC power source and the heating body and configured to switch supply of the power from the AC power source to the heating body; and a detector configured to detect AC voltage of the AC power source, the program instructions comprising:

detecting a zero-cross timing of the AC voltage by using the detector;

generating a signal having a high level period of time, a low level period of time, a rising transition changing from a low level to a high level, and a falling transition changing from the high level to the low level, the signal being such a form that at least one of the rising transition and the falling transition is in incoincidence with the zero-cross timing; and controlling the heating switch to perform a switching action in which the heating switch is rendered on when the zero-cross timing is detected during the high level period of time and rendered off when the zero-cross timing is detected during the low level period of time, wherein the signal is generated such that a duration of time between two successive zero-cross timings is different from one of the high level period of time and the low level period of time.

21. The non-transitory computer readable storage medium according to claim 20, wherein the signal is generated such that the high level period of time is longer than the duration of time.

22. The non-transitory computer readable storage medium according to claim 20, wherein the signal is generated such that the rising transition is set to be in coincidence with one of a maximum voltage and a minimum voltage of the AC voltage, and the falling transition is set to be in coincidence with the remaining one of the maximum voltage and the minimum voltage of the AC voltage.

23. The non-transitory computer readable storage medium according to claim 20, where the program instructions are for further controlling an image forming unit that is capable of printing an image on a sheet up to a prescribed maximum size, wherein the fixing device is capable of fixing an image on the sheet having the maximum size during a maximum fixing duration of time, wherein the program instructions further comprise:

determining a zero-cross-to-zero-cross duration of time between two successive zero-cross timings by using the detector; and setting a reference period of time such that a product of a first value and a second value is shorter than the zero-cross duration of time, the first value being obtained by dividing the maximum fixing duration of time by the reference period of time, the second value being a time difference between the zero-cross-to-zero-cross duration of time and the reference period of time, the reference period of time being used when the signal pattern is generated.

24. The non-transitory computer readable storage medium according to claim 20, wherein the program instructions are for further controlling:

a conveying unit configured to convey the sheet to the fixing device via the image forming unit; and a sensor configured to detect a sheet at the fixing device, wherein the program instructions further comprise:

controlling the conveying unit to convey the sheet; and acquiring a detection result from the sensor, wherein the switching action is executed when acquiring the detection result indicating that the sheet is detected, wherein the program instructions further comprise:

stopping the switching action by interrupting power from the AC power source to the heating device when acquiring the detection result indicating that sheet is absent; and reconfiguring the signal when the switching action is stopped and the conveying unit conveys the sheet.

25. The non-transitory computer readable storage medium according to claim 24, wherein the program instructions are for further controlling a detection switch through which the sensor is connected to the AC power source, the detection switch switching supply of power from the AC power source to the sensor, wherein the program instructions further comprise:

turning on the detection switch when the sensor detects the sheet; and turning off the detection switch when the sensor does not detect the sheet.

26. The non-transitory computer readable storage medium according to claim 20, wherein the generating includes generating a signal pattern having the high level period of time, the low level period of time, the rising transition changing from the low level to the high level, and the falling transition changing from the high level to the low level, the signal pattern being such a form that at least one of the rising transition and the falling transition is to be in incoincidence with a zero-cross timing of the AC voltage, wherein the signal is generated on a basis of the generated signal pattern.

27. The non-transitory computer readable storage medium according to claim 22, wherein the program instructions further comprises determining the duration of time by using the detector.

* * * * *